US005760356A

United States Patent [19]

Garcia et al.

[11] Patent Number: 5,760,356

[45] Date of Patent: Jun. 2, 1998

[54] DEVICE ASSEMBLY WITH SEALED SWITCH ACTUATOR INTERFACE

[75] Inventors: Jorge L. Garcia, Plantation; Jerry R. Nichols, Boynton Beach; Orlando Hernandez, Sunrise, all of Fla.

[73] Assignee: Motorola, Inc., Schaumburg, Ill.

[21] Appl. No.: 657,233

[22] Filed: Jun. 3, 1996

[51] Int. Cl.[6] ..... H01H 13/06

[52] U.S. Cl. ..... 200/302.2; 200/302.1

[58] Field of Search ..... 200/302.2, 302.1, 200/330, 332, 517, 512, 333

[56] References Cited

U.S. PATENT DOCUMENTS

| | | | |
|---|---|---|---|
| 3,172,981 | 3/1965 | Loesch | 200/202.2 |
| 4,139,744 | 2/1979 | Pypno | 179/167 |
| 4,453,061 | 6/1984 | Tomura | 200/302.2 |
| 4,679,233 | 7/1987 | Richardson et al. | 379/433 |
| 4,845,325 | 7/1989 | Burchett et al. | 200/302.2 |
| 5,367,133 | 11/1994 | Schmidt et al. | 200/5 |
| 5,389,757 | 2/1995 | Souliere | 200/345 |
| 5,426,273 | 6/1995 | Shiau | 200/302.2 |

FOREIGN PATENT DOCUMENTS

| | | | |
|---|---|---|---|
| 2856686 | 7/1979 | Germany | 200/302.2 |

*Primary Examiner*—David J. Walczak
*Attorney, Agent, or Firm*—Andrew S. Fuller

[57] ABSTRACT

A device assembly (100) has a switch actuator assembly (150) with a sealed interface. The device assembly (100) includes a housing (120) having an opening (126) that provides access to an internal switch (135). A switch actuator (160) selectively actuates the switch (135) through the opening (126). The switch actuator (160) includes a seal (164) that is disposed around the opening (126). An external actuator cover (180) includes a seal support member (185) that positions the seal (164) against a seal mount (128) about the opening (126), when the actuator cover (180) is depressed.

19 Claims, 3 Drawing Sheets

DEVICE ASSEMBLY WITH SEALED SWITCH ACTUATOR INTERFACE

TECHNICAL FIELD

This invention relates in general to switch actuator assemblies, and more particularly, switch actuator assemblies having a sealed interface to an electrical device.

BACKGROUND

Many electronic devices provide an external interface, such as a keypad, knob or button, to support operational control by a user. In a typical electronic device, a housing protects internal components, and external controls interface with these internal components through openings within the housing. Oftentimes, an electronic device must be sealed to provide protection against environmental contaminants, such as dust, water, and the like. In one example, a hand-held microphone assembly interfaces to a mobile communication device. The hand-held microphone assembly includes an externally actuated push-to-talk switch that activates a microphone, and simultaneously enables a transmission mode in the communication device. Generally, a push-to-talk switch assembly is provided that includes a relatively large external actuator, such as a lever, panel, or the like, that is attached to a housing member of the microphone assembly. The external actuator interfaces with a switch internal to the microphone assembly via an access opening or interface port within the housing member. The interface between the external actuator portion of the push-to-talk switch assembly and the internally mounted switch is sometimes sealed to prevent environmental contaminants from entering into the microphone assembly through the interface port.

A switch actuator is preferably designed to provide a good tactile response, such that a user receives a positive feedback indicating that the switch has been actuated. In the special case of a push-to-talk switch, a user typically actuates the switch by holding the actuator in place for an extended period of time. To reduce fatigue in such cases, it is desirable to design a switch actuator with a tactile response that provides a reduced resistance, once the switch has been engaged.

The prior art teaches a variety of approaches for providing a switch actuation assembly with an appropriate tactile response, such as may be used in a push-to-talk switch application. In one approach, a switch actuator assembly includes a resilient elastomeric switch actuator having a central actuator portion supported by a peripheral conical base which provides a resistive force when the actuator is depressed. When the actuator is no longer depressed, the conical base provides a restoring force. Such switch actuation devices are present in the art in a variety of forms and have been used for keypads and other control buttons.

For applications requiring a sealed interface between the actuator and the internal compartment of the device, it is known to associate a seal around the actuator. The seal is ordinarily secured to the device via a clamp, bracket, or other fastener. These seal attachment arrangements may require multiple parts, and complex assembly operations. The assembly operations and parts contribute to overall manufacturing cost. It is desirable to provide for a sealed actuator assembly, such as could be used for a push-to-talk switch application, which has a reduced number of parts, and which facilitates assembly and disassembly.

DETAILED DESCRIPTION OF THE PREFERRED EMBODIMENT

Generally, the present invention provides for a device assembly with a sealed switch actuator interface. The device assembly includes a housing having an opening that provides access to an internal switch. A resilient switch actuator selectively actuates the switch through the opening. The switch actuator includes a seal that is disposed around the opening. An external actuator cover, mechanically coupled to the switch actuator, includes a seal support member that positions the seal against the housing. Preferably, a seal mount, such as a groove, is located about the opening, and the seal support member positions the seal to be captured by the seal mount when the actuator cover is depressed.

Figure 1:
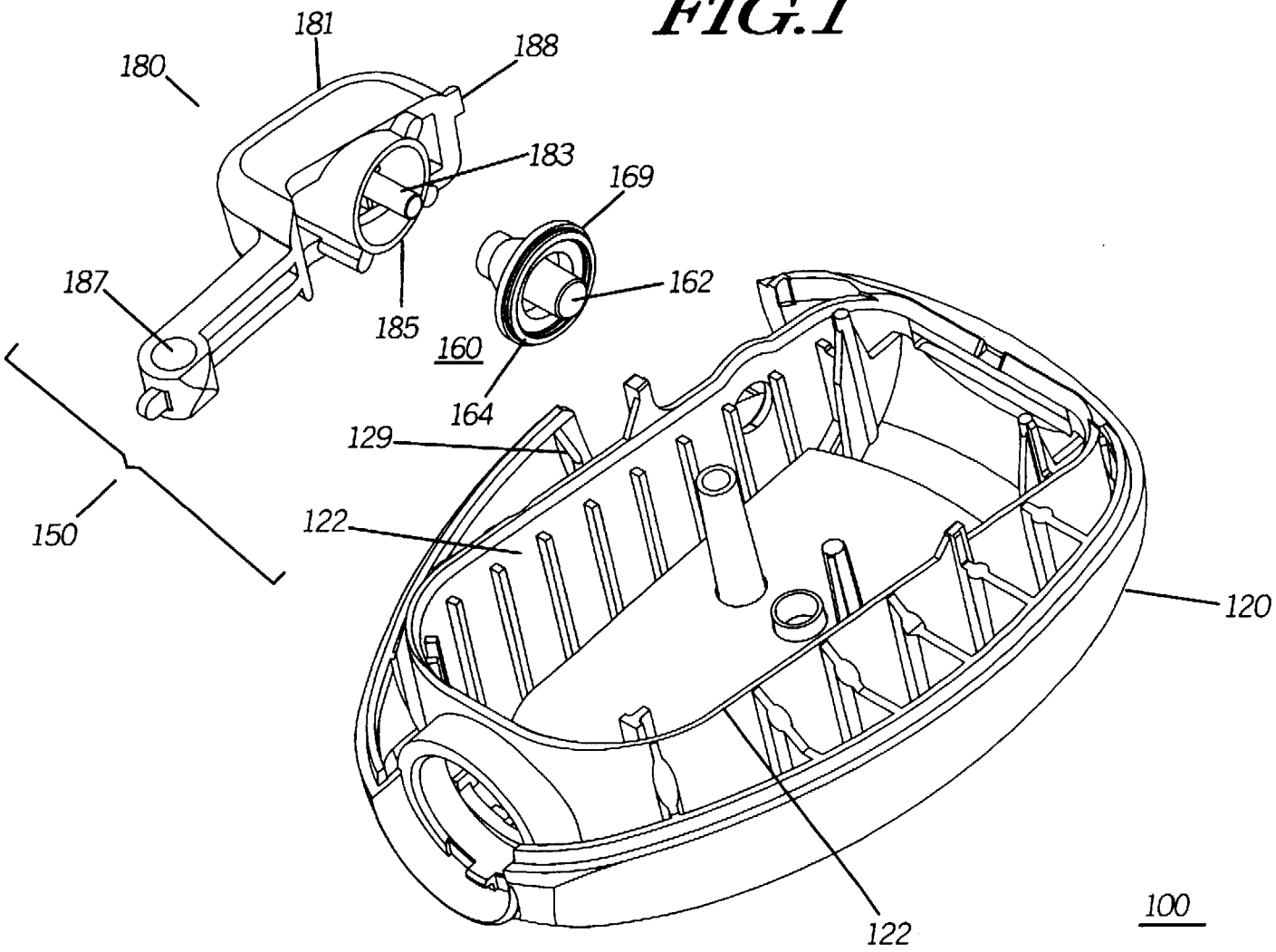
FIG. 1 is a first orientation of a partial microphone assembly, incorporating a sealed switch actuator assembly, in accordance with the present invention.
Figure 2:
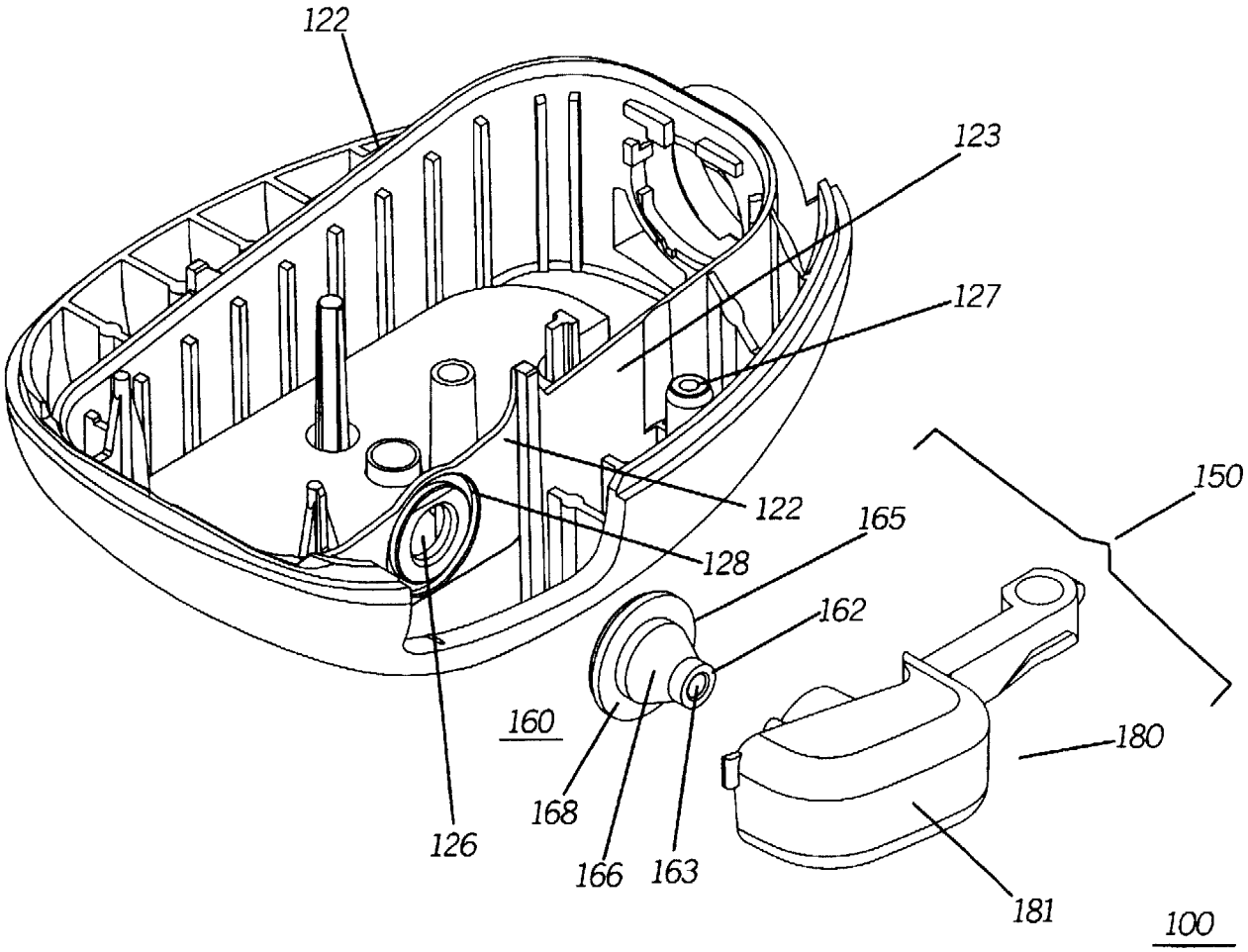
FIG. 2 is a second orientation of the partial microphone assembly of FIG. 1.
Figure 3:
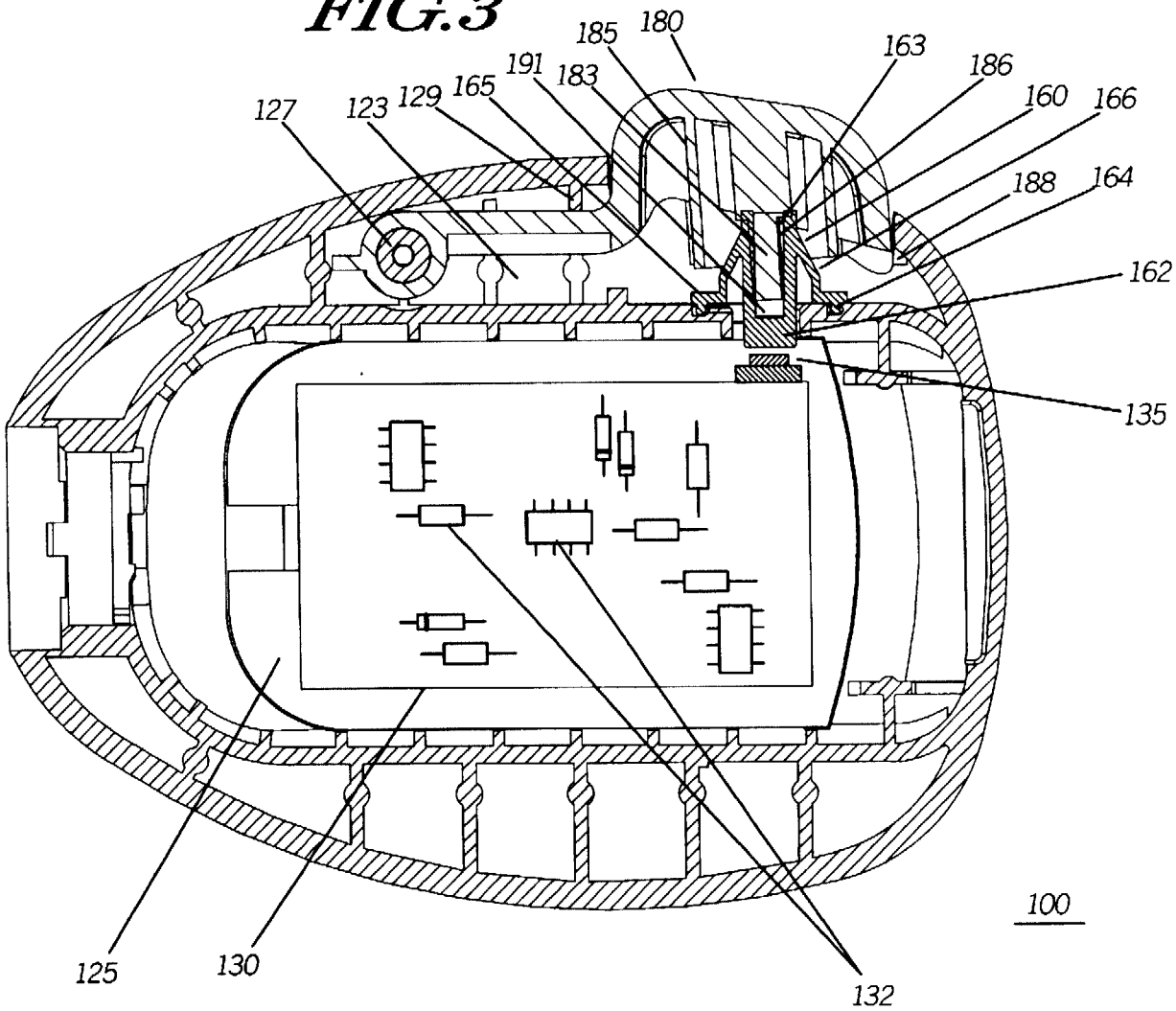
FIG. 3 is a cross-sectional view of a microphone assembly, in accordance with the present invention.

FIG. 1 is a first orientation of a partial microphone assembly 100, in accordance with the present invention. FIG. 2 shows a second orientation of the partial microphone assembly 100 of FIG. 1. FIG. 3 is a cross-sectional view of the microphone assembly 100, in accordance with the present invention. Referring to FIGS. 1, 2 and 3, the microphone assembly 100 is a hand-held electronic communication device that interfaces with a mobile two-way communication unit (not shown). The microphone assembly 100 includes a device housing 120, and a switch actuator assembly 150. A compartment 123 within the device housing 120 houses the switch actuator assembly 150, and includes a pivot mount or post 127 for the switch actuator assembly 150 in the preferred embodiment. A projection 129 acts as a travel stop for the switch actuator assembly 150. The device housing 120 further includes a sealed compartment 125 that houses internal electrical and mechanical components. The internal components includes a circuit substrate 130 that carries circuit components 132, 135 that implement the functions of the microphone device. The circuit components 132, 135 include a switch 135 electrically and mechanically coupled to the circuit substrate 130. The switch 135 enables and disables the input and transmission of audio signals through the microphone device. Preferably, the switch 135 is momentary tactile switch that is enabled when engaged and disabled when not engaged.

The sealed compartment 125 is formed by peripheral sidewalls 122 that intersect to form a walled enclosure. An opening 126 in one of the sidewalls 122 forms a switch port that provides access to the switch 135 within the sealed compartment 125. The opening 126 is preferably aligned with the switch 135. The housing 120 further includes a seal mount 128 in the form of a groove extending peripherally around the opening on the outer surface of the sealed compartment 125.

The switch actuator assembly 150 includes an actuator member 160, that functions as a combination seal, return spring, and switch actuator; and an actuator cover or lever 180, that provides a user interface or external actuator. The actuator member 160 is preferably formed from elastomeric or other resilient or elastic material in a single-piece molded construction. The resilient actuator member 160 includes a peripheral base portion 165 that supports a centrally disposed actuator portion 162 by a conical sidewall 166. The conical sidewall 166 provides a return spring function for the switch actuator assembly 150. In the preferred embodiment, the peripheral base portion extends in a circular fashion about the actuator member 160 and serves as a mount point for actuator member. The peripheral base portion 165 has a substantially flat top surface 168, and an opposing bottom surface 169. The bottom surface 169 has a portion 164 that projects to form, a seal. The actuator portion 162 preferably comprises a cylindrical rod with a central bore or hollow 163 that partially extends through the rod 162.

The actuator cover 180 is preferably formed from hard plastic material in a single-piece molded construction. The actuator cover 180 includes an outer casing 181 that provides a user interface or external surface. The outer casing 181 houses an actuator mount shaft 183 and a seal support member 185. The shaft 183 provides a mount for the actuator member 160 during assembly. The seal support member 185 is formed to interface with the peripheral base 165 of the actuator member 160. According to the present invention, the seal support member acts to position the seal 164, with respect to the seal mount 128, such that the seal mount 128 captures the seal.

In the preferred embodiment, the actuator cover 180 further includes a pivot mount 187, in the form of a hole or slot, and a retaining tab 188. The seal support member is in the form of a cylindrical projection disposed about the actuator mount shaft 183. The actuator mount shaft is formed to fit within the hollow of the cylindrical rod or actuator portion 162 of the actuator member 160. The actuator mount shaft 183 is preferably formed to be shorter in length than the hollow 163 is in depth so as to leave a gap 191 within the actuator portion 162 when the actuator member 160 is mounted on the actuator mount shaft 183. The shaft 183 preferably has an air bleed groove 186 formed therein to facilitate the passage of air to and from the gap 191 within the actuator portion 162 during use of the switch actuator assembly 150.

To assemble, the actuator member 160 is mounted on the actuator mount shaft 183 of the cover 180, in a pressure fitted mount arrangement, to form the switch actuator assembly 150. The shaft 183 mounts within the hollow 163 of the actuator portion 162. The switch actuator assembly is then positioned, with respect to the housing 120, such that the actuator portion 162 is positioned within or at least aligned with the opening 126 in the sealed compartment 125. Such alignment also causes the seal 164 to be positioned at or near the seal mount 128. In the preferred embodiment, the switch actuator assembly 150 is then positioned such that the pivot slot 187 in the actuator cover 180 is mounted to the pivot mount 127 on the housing, such that the actuator cover 180 is pivotable about the pivot mount 127. Simultaneously, the actuator member provides a biasing force against the actuator cover 180 which biases the actuator cover against the travel stop 129.

According to the present invention, the seal portion 164 of the actuator member 160 is then mounted to the seal mount 128 by depressing the actuator cover 180 such that the seal support member 185 buttresses the seal 164 against the housing. When the actuator cover 180 is depressed, the seal support member 185 is substantially aligned with the peripheral base portion 165. The seal support member 185 engages the peripheral base portion 165 of the actuator member 160, such that force is transferred from the seal support member 185 via the peripheral base portion 165 to the seal 164. In the preferred embodiment, this causes the seal 164 to be seated within the seal groove 128 in a pressure fit arrangement. Here, the seal support member 185 is preferably aligned with the seal 164 such that a portion of the force generated by depressing the actuator cover is transferred to urge the seal 164 into the seal groove 128.

When assembled, the seal 164 engages the seal groove 128 to provide a hermetic seal for the opening 126 to the sealed compartment 125. In the preferred embodiment, the actuator portion 162 partially extends within the opening and is aligned with the switch 135. The gap 191 between the shaft 183 and the bottom portion of the hole 163 provides an over travel region that serves to protect the switch 135, while providing a proper tactile response to a user. The cover 180 is depressible or movable between a switch engaging position, and a position whereby the switch is disengaged. When the cover 180 is depressed to or biased in the switch engaging position, the seal support member 185 presses against the peripheral base portion 165, whereby the seal 164 is buttressed against the seal mount 128. If the seal becomes unseated by shock or otherwise, the seal support member 185 acts to reseat the seal when the switch actuator is used. When released, the actuator cover is biased against a portion of the housing 120 by the spring action of the actuator member 160. In the preferred embodiment, the depressible cover forms a push-to-talk button or lever that enables and disables communication via the microphone.

The present invention provides significant advantages over the prior art. The number of separate parts required for a sealed switch actuator assembly has been reduced. By reducing the number of parts and simplifying the assembly operation, manufacturing cost has been reduced for an electrical device having a sealed switch actuator that provides external actuation.

What is claimed is:

1. A device assembly with a sealed switch actuator interface, comprising:

a housing having a surface portion, and an opening extending to the surface portion;

a switch actuator having a single-piece construction and comprising an actuator portion and a seal;

a seal mount formed on the surface portion of the housing, and extending peripherally around the opening of the housing, the seal mount being formed to capture the seal in a pressure fit arrangement; and a depressible cover mounted over the switch actuator and mechanically coupled to the actuator portion, the depressible cover including a projecting seal support member;

wherein:

the seal is disposed around the opening; and the seal support member engages the seal, when the depressible cover is depressed, to position and buttress the seal against the seal mount such that seal is captured by the seal mount.

2. The device assembly of claim 1, wherein:

the switch actuator comprises a resilient member which comprises a peripheral base portion, the peripheral base portion having the seal projecting therefrom; and the seal support member is substantially aligned with the peripheral base portion, when the cover is depressed.

3. The device assembly of claim 2, wherein:

the resilient member further comprises a conical sidewall extending from the peripheral base portion; and the actuator portion comprises a hollow rod centrally supported by conical sidewall;

wherein the conical sidewall provides a spring return force for the depressible cover.

4. A device assembly with a sealed switch actuator interface, comprising:

a housing having an opening, and a seal mount disposed about the opening;

a switch actuator formed of resilient material, the switch actuator having a peripheral base portion having a conical sidewall extending therefrom, the peripheral base portion having a seal thereon, which seal is disposed around the opening, the switch actuator having an actuator portion comprising a hollow rod centrally supported by the conical sidewall and the peripheral base portion; and a depressible cover mounted over the switch actuator and mechanically coupled to the actuator portion, the depressible cover including a seal support member;

wherein:

the cover comprises a shaft, the shaft being mounted within the hollow rod; and the seal support member comprises a cylindrical projection disposed about the shaft; and wherein, when the depressible cover is depressed, the seal support member is substantially aligned with the peripheral base portion and buttresses the seal against the housing to assemble the seal to the housing such that the seal mount captures the seal.

5. The device assembly of claim 4, wherein the shaft has an air bleed groove disposed thereon.

6. A switch actuator assembly, comprising:

a housing with an opening and a seal groove about the opening;

a resilient switch actuator having a single-piece construction, and having an integral seal portion seated within the seal groove; and a depressible cover mounted over the resilient switch actuator, the depressible cover including a protruding support member that urges the seal portion within the seal groove when the cover is depressed.

7. The switch actuator assembly of claim 6, wherein:

the housing comprises a sealed compartment that includes a sidewall; and the opening is disposed within the sidewall.

8. The switch actuator assembly of claim 7, further comprising a switch mounted within the housing and aligned with the opening.

9. The switch actuator assembly of claim 8, wherein the resilient switch actuator is formed from elastomeric material.

10. The switch actuator assembly of claim 6, wherein the resilient switch actuator provides a return spring biasing force against the depressible cover.

11. The switch actuator assembly of claim 6, wherein the resilient switch actuator comprises:

a peripheral base portion;

a conical sidewall extending from the peripheral base portion; and a cylindrical rod supported by the conical sidewall.

12. The switch actuator assembly of claim 11, wherein the seal portion is formed on the peripheral base portion.

13. The switch actuator assembly of claim 6, wherein the depressible cover comprises a lever pivotably mounted to the housing.

14. An assembly, comprising:

a sealed compartment having an opening, and a seal groove situated about the opening in a spaced apart relationship;

a switch mounted within the sealed compartment and accessible through the opening;

a seal disposed about the opening; and an actuator cover, movable between first and second positions, the actuator cover having a seal support member projecting therefrom that positions the seal to be captured by the seal mount.

15. The assembly of claim 14, further comprising an elastic member that biases the actuator cover into the first position, wherein a portion of the elastic member projects to form the seal.

16. The assembly of claim 15, wherein the seal support member buttresses the seal against the seal mount, when the actuator is biased into the second position.

17. A communication device assembly, comprising:

a housing having a sealed compartment, the sealed compartment including a sidewall with an opening therein, the sidewall comprising a seal groove that extends about the opening;

a switch mounted within the sealed compartment, and having a portion aligned with the opening;

a resilient actuator mounted about the opening, and having an integral seal, portion interfacing with the sidewall to provide a seal for the opening, the resilient actuator, including the integral seal, having a single-piece construction;

a push-to-talk button mounted to the housing and over the resilient actuator, the push-to-talk button having a seal support member projecting therefrom;

wherein the push-to-talk button is depressible to actuate the switch, and the seal support member engages the resilient actuator to buttress and urge the integral seal portion into the seal groove when the push-to-talk button is depressed.

18. The communication device of claim 17, wherein the resilient actuator and integral seal portion is formed from a single-piece molded elastomeric part.

19. The communication device of claim 17, wherein the push-to-talk button comprises a lever pivotably mounted to the housing.

* * * * *